United States Patent [19]

Hamm

[11] 4,431,154

[45] Feb. 14, 1984

[54] HOLDER FOR MOUNTING ON A RAIL AND THE LIKE

[76] Inventor: H. Keith Hamm, P.O. Box 135, Perry, Kans. 66703

[21] Appl. No.: 376,301

[22] Filed: May 10, 1982

[51] Int. Cl.[3] ..... A47B 96/06; A47G 55/00

[52] U.S. Cl. ..... 248/215; 5/503; 248/311.2

[58] Field of Search ..... 248/215, 304, 314, 339, 248/348, 224.4, 222.1, 223.4, 225.1, 224.3, 214, 221.3, 221.4; 179/146 R; 5/503; 211/192; 24/213 B, 230 AS, 230 A

[56] References Cited

U.S. PATENT DOCUMENTS

| | | | |
|---|---|---|---|
| 839,654 | 12/1906 | Seachrest | 248/315 X |
| 1,686,002 | 10/1928 | Herzon | 5/503 X |
| 2,123,231 | 7/1938 | Clemence | 248/214 X |
| 2,665,103 | 1/1954 | Flora et al. | 248/314 |
| 2,721,718 | 10/1955 | Wagner | 248/214 |
| 2,884,666 | 7/1958 | Monsler . | |
| 2,993,672 | 7/1961 | Bower et al. | 248/215 |
| 3,009,676 | 11/1961 | Bachwald . | |
| 3,068,492 | 12/1962 | Price | 248/311.2 X |
| 3,269,683 | 8/1966 | Shinaver | 248/311.2 X |
| 3,538,267 | 11/1970 | Ross . | |
| 3,757,363 | 9/1973 | Langlais . | |
| 3,802,657 | 4/1974 | Jackson . | |
| 4,088,848 | 5/1978 | Weed . | |
| 4,203,175 | 5/1980 | Heine . | |

FOREIGN PATENT DOCUMENTS

| | | | |
|---|---|---|---|
| 2451175 | 11/1980 | France | 24/230 AS |

*Primary Examiner*—Ramon S. Britts
*Assistant Examiner*—Sarah A. Lechok
*Attorney, Agent, or Firm*—Litman, Day & McMahon

[57] ABSTRACT

A holder for mounting on a rail and the like comprising a body forming a receptacle and having a body back wall. A bracket is attached to the body back wall and forms a receiver therewith. A clip is removably attached to the body by inserting a tab portion thereof into the receiver. The clip also includes a hook portion for engagement with the rail and the like. A resilient leg extending outwardly from the tab portion and engageable with the body is provided for removably securing the tab portion in the receiver.

5 Claims, 8 Drawing Figures

Fig. 1.
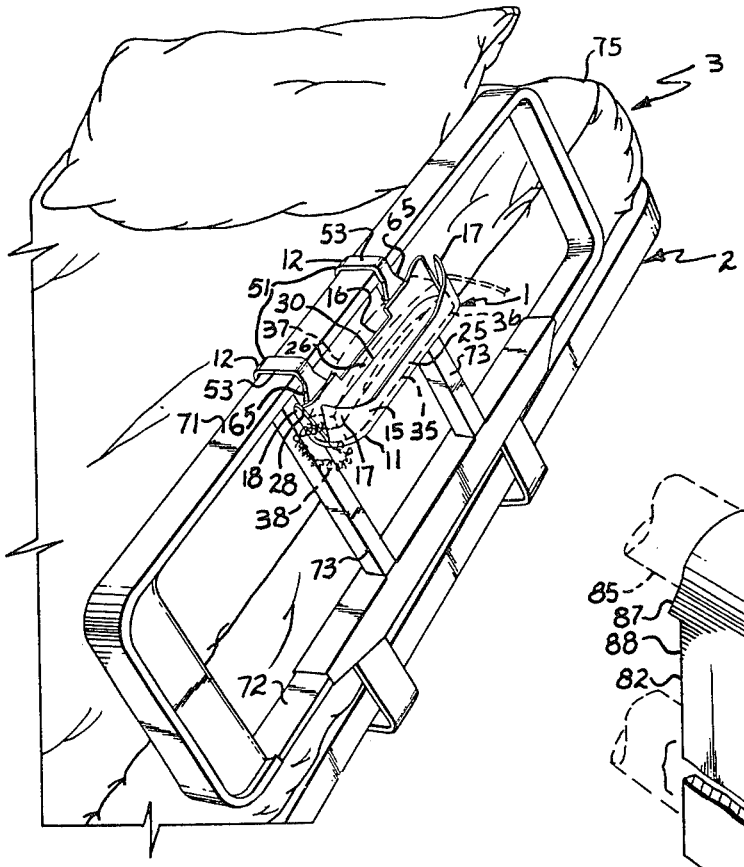
Fig. 5.
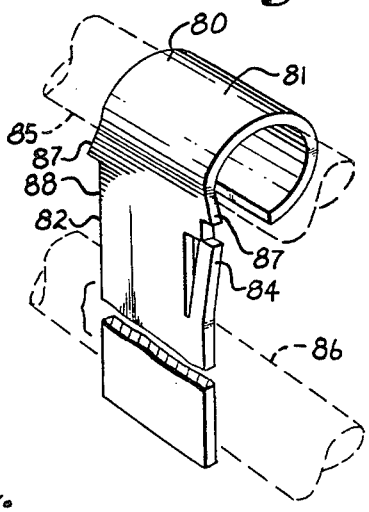
Fig. 3.
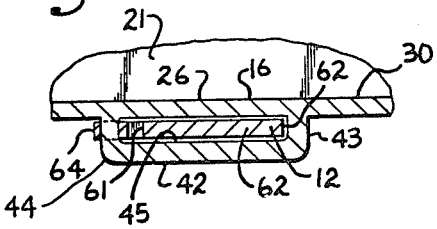
Fig. 2.
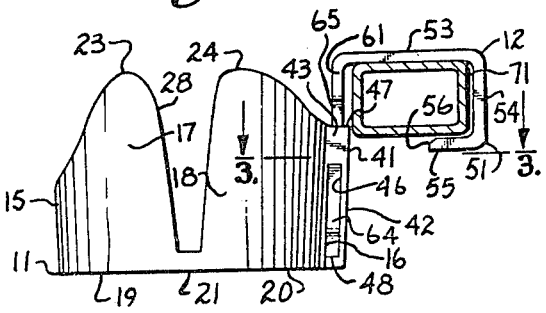
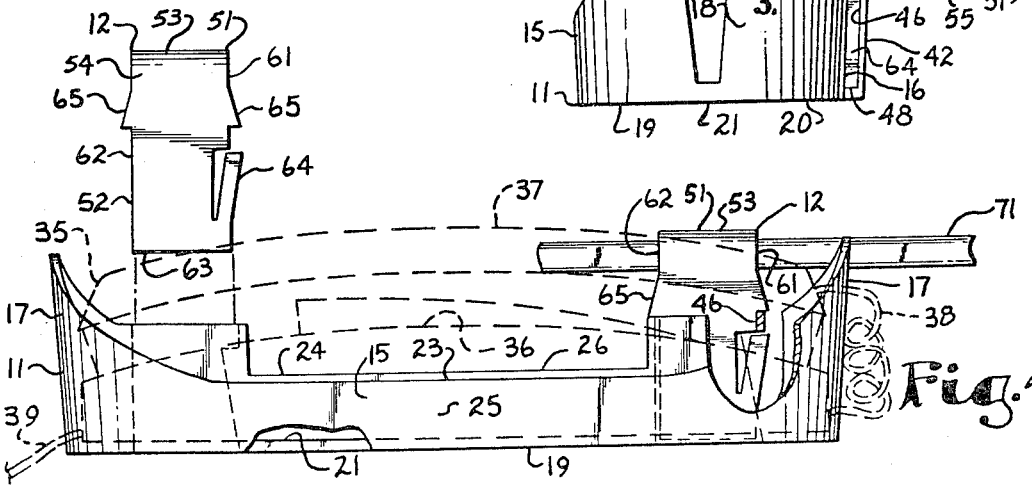
Fig. 4.

HOLDER FOR MOUNTING ON A RAIL AND THE LIKE

BACKGROUND OF THE INVENTION

1. Field of the Invention

This invention relates to holders, and in particular to a holder mountable on a bed rail and the like for a telephone or a patient communicator.

2. Description of the Prior Art

In hospitals, nursing homes, convelescent facilities and the like, bedridden patients are often provided with communication devices for their convenience, entertainment and even safety. For example, telephones may be found at the bedsides in many such facilities. Also, patient communicators having a nurse call button whereby the patient can electronically summon assistance from persons at a remote locations are well known. Such patient communicators may also serve other communications functions, for example, as the controls for a television positioned in the patient's room. Further, a television or radio speaker may be provided in the patient communicator for relatively private listening without disturbing others.

A common problem in the use of such communication devices relates to their placement in positions conveniently accessible by a bedridden patient, particularly one with a limited range of movement. For example, a typical practice is to place the telephone on a table or night stand in proximity to the bed whereby a bedridden person has to turn on his or her side and/or reach backward in order to pick up the telephone. However, the patient was often hampered by a raised side rail positioned between him or her and the telephone. Hospital type beds typically have such side rails to prevent patients from inadvertently rolling out of them. To place the telephone closer to the patient, holders have been devised which mount on some part of the bed. For example, it is known to provide a holder having a receptacle for receiving the telephone with a clamp for attachment to the head board of the bed. However, a telephone mounted in such a device is out of the normal range of sight of a patient who must either grope for it or turn at an awkward angle to see it.

Another type of telephone holder or bracket is shown in the Jackson U.S. Pat. No. 3,802,657 and comprises a single unitary length of wire formed in a predetermined configuration for mounting on a pair of bed rails. A significant disadvantage thereof is that it is primarily adapted for use with a Trim-line telephone and with a particular type of hospital bed having spaced upper and lower rails.

Patient communicators, on the other hand, are often clipped onto the bedding whereat they may become displaced, difficult to reach, or in the way of the patient and/or a person making the bed. Because the patient communicators serve as an emergency device whereby patients can quickly summon assistance, it is very important that they be readily accessible even by a patient with a limited range of movement. Therefore, alternative mounting means for patient communicators have been devised, as exemplified by the Langlais U.S. Pat. No. 3,757,363. A C-clamp for attachment to a bed frame is shown therein with a bendable arm holding a cradle for adjustably supporting the patient communicator. However, the clamp of this structure is accessible from beneath the bed frame is thus not readily removable in case of interference with raising and/or lowering the side rail, moving the patient in or out of the bed, etc. Furthermore, the relatively long bendable arm may be seen as a disadvantage necessitating a relatively high cost.

To overcome these problems, the side rails of a hospital bed have been used for mounting a patient communicator because it is thus located in a conveniently accessible predetermined position whereat interference with bedding and the patient is avoided. For example, bed rails have been devised with built-in patient communicators facing inwardly between upper and lower bed rails. However, equipping existing hospital beds with such patient communicators generally requires replacing the existing bed rails and patient communicators at considerable expense.

Prior art holders for mounting telephones and patient communicators on or adjacent hospital-type beds have thus tended to be inconvenient, costly, or incompatible with a variety of different types of telephones, patient communicators and bed rails. In particular, there has heretofore not been available a holder system with interchangable bodies for various types of telephones and patient communicators and clips for different types of bed rails.

SUMMARY OF THE INVENTION

In the practice of the present invention, a holder for mounting on a rail and the like is provided which includes a body having a receptacle and a clip removably attached thereto. The body includes a back wall with a bracket mounted thereon and forming a receiver therewith. The clip comprises a hook portion engageable with the rail and the like and a tab portion inserted in the receiver and removably retained therein by lock means. The body may be formed in various configurations to accommodate, for example, different types of telephones and patient communicators. Clips having different hook portion shapes may be provided to receive different types of bed rails. The various types of bodies and clips are interchangeable whereby the appropriate holder may be assembled for virtually any application.

Conversion to the holder system of the present invention is particularly advantageous in existing hospitals because only the necessary bodies and clips must be acquired. Holders to accommodate the hospital's preexisting telephones, patient communicators and bed rails can then be easily assembled and placed in service. Thus, a health care facility may be retrofitted with holders embodying the present invention at a relatively low cost and without having to replace their expensive existing equipment. Even if the existing telephones, patient communicators and bed rails are of a variety of different designs, an assortment of bodies and clips could be procured from which the necessary holders could be assembled.

OBJECTS OF THE INVENTION

The principal objects of the present invention are: to provide a holder for mounting a telephone or patient communicator in a conveniently accessible predetermined position on a hospital-type bed; to provide such a holder for detachable mounting on a bed rail; to provide such a holder compatible with a variety of different types of telephones and patient communicators; to provide such a holder which is compatible with a variety of different types of bed rails; to provide such a holder which may be easily mounted on existing hospital bed rails; to provide such a holder with a body and a detachable clip; to provide such a holder with a variety of interchangeable bodies and clips; to provide such a holder wherein the clip comprises a more flexible material than the body; to provide such a holder for mounting a telephone and a patient communicator out of the way on a side rail; to provide such a holder which is economical to manufacture, efficient in use and capable of a long operating life.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a telephone holder embodying the present invention shown mounted on a hospital type bed side rail.

FIG. 2 is an enlarged, end elevational view of the holder.

FIG. 3 is an enlarged, fragmentary, horizontal cross-sectional view of the holder taken generally along line 3—3 in FIG. 2 and particularly showing a bracket with a clip tab portion inserted therein.

FIG. 4 is an enlarged, front elevational view of the holder showing one of the clips removed.

FIG. 5 is an enlarged perspective view of a clip having an alternative configuration with a curved hook portion.

DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 6:
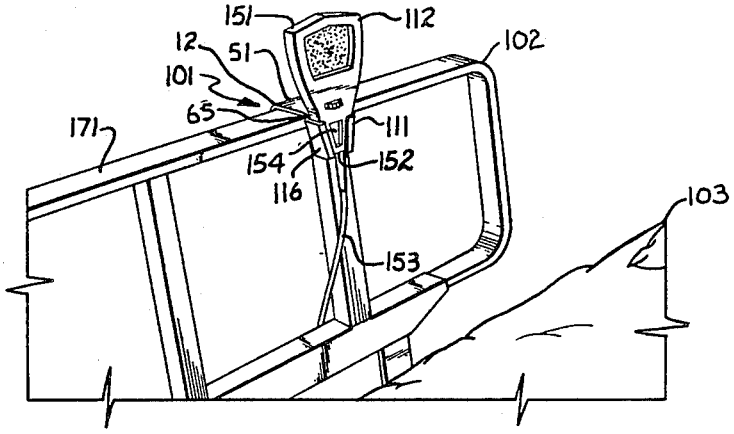
FIG. 6 is a perspective view of a patient communicator holder comprising a first modified embodiment of the present invention shown mounted on a hospital type bed side rail.
Figure 8:
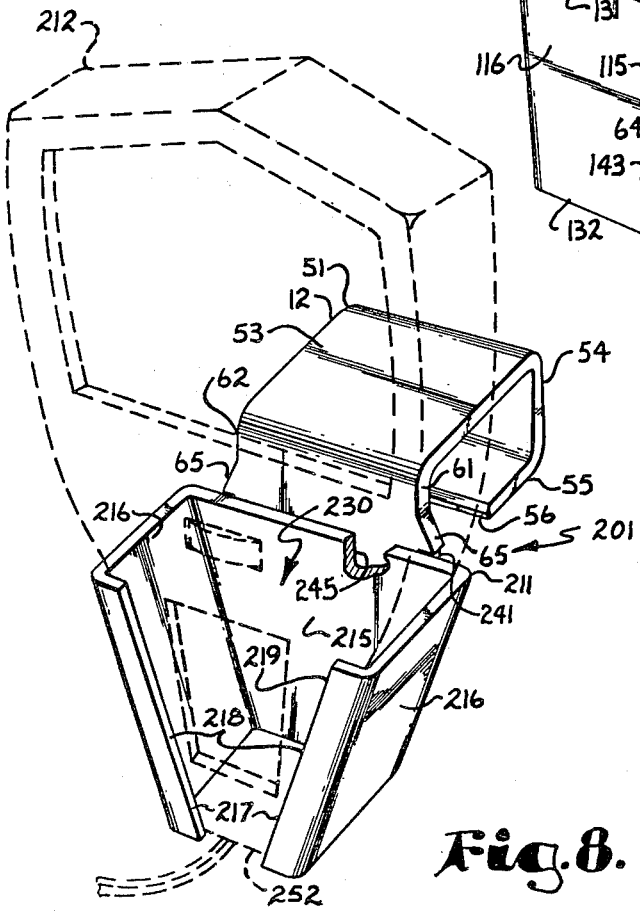
FIG. 8 is a perspective view of a patient communicator holder comprising a second modified embodiment of the present invention.

For purposes of description herein, the terms "upper", "lower", "right", "left", "front", "rear", "vertical", "horizontal" and derivatives thereof shall relate to the invention as oriented in FIG. 4 for the primary embodiment and as oriented in FIGS. 6 and 8 for the first and second modified emodiments respectively. However, it is to be understood that the invention may assume various alternative orientations, except where expressly specified to the contrary.

Referring to the drawings in more detail, the reference numeral 1 generally designates a holder for mounting on a side rail assembly 2 of a hospital type bed 3. The holder 1 primarily comprises a body 11 and a pair of clips 12. The body 11 includes front and back walls 15 and 16 respectively terminating in front and back curved ends 17 and 18 respectively. The front and back walls 15 and 16 terminate in respective front and back lower edges 19 and 20 integrally connected to a base 21. From their lower edges 19 and 20 the front and back walls 15 and 16 extend upwardly to and terminate at front and back upper edges 23 and 24 respectively. As shown in FIGS. 2 and 4, the wall upper edges 23 and 24 are positioned higher at the respective front and back wall ends 17 and 18 than at front and back wall mid-sections 25 and 26 respectively, for purposes which will be more fully set out hereinafter.

Corresponding pairs of front wall ends 17 and back wall ends 18 are each separated by a respective slot 28 open between the wall upper edges 23 and 24 at the wall ends 17 and 18. The slots 28 extend downwardly in converging configurations and terminate in slightly spaced relation above the the front and back wall lower edges 19 and 20. A receptacle 30 is formed by the respective front and back walls 15 and 16 and the base 21 and is open at the wall upper edges 23 and 24 and at the slots 28. The receptacle 30 is adapted to receive a telephone 35 shown in dashed lines and generally comprising a base unit 36 and a combination handset and dial unit 37. (FIGS. 1 and 4). The telephone 35 is of the type available under the trademark Trim-line and includes a first line or cord 39 extending from its base unit 36 to a junction box (not shown) whereat it connects to the telephone line. A coiled second line or cord 38 interconnects the base unit 36 and the handset unit 37.

The body 11 includes a pair of brackets 41 each comprising a bracket back wall 42 and first and second bracket side walls 43 and 44 integrally connected thereto and extending forwardly therefrom to attachment with the body back wall 16. The brackets 41 are each attached to the back wall mid-section 26 adjacent a respective back wall end 18. The bracket back walls 42 are fixedly positioned in spaced relation rearwardly of the body back wall 16 and form receivers 46 therebetween. Each first bracket side wall 43 includes an opening 46 communicating with a respective receiver 45. The receivers 45 are also open at tops and bottoms 47 and 48 of the brackets 41.

The clips 12 each comprise integrally connected hook and tab portions 51 and 52. Each hook portion 51 includes a top flange 53 integrally connected to the tab portion 52 and extending rearwardly therefrom, a back flange 54 integrally connected to the top flange 53 and depending downwardly therefrom and a bottom flange 55 integrally connected to the back flange 54 and extending forwardly therefrom. As shown in FIG. 2, the tab portion 52 and the top flange 53 form an interior angle at their intersection of slightly greater than 90 degrees. The flanges 53, 54 and 55 form substantially right angles at their respective intersections. The tab portions 52 display respective first and second side margins 61 and 62 and terminate at respective lower ends 63. Lock means for removably securing each tab portion 52 in a respective receiver 45 comprise resilient spring legs 64 biased outwardly from each respective tab first side margin 61 (FIG. 3). A pair of generally triangular shaped stops 65 extend outwardly from the first and second side margins 61 and 62.

In use, the holder 11 may be mounted on a top rail 71 of the side rail assembly 2 which also includes a bottom rail 72 and an upright rail 73 interconnecting the top and bottom rails 71 and 72 respectively. The holder 1 is first assembled by inserting the tab portions 52 of the clips 12 past the open bracket tops 47 and sliding them into the respective receivers 45. The clip legs 64 slidably engage and are compressed inwardly by respective first bracket side walls 43 until fully inserted whereat they spring outwardly into respective openings 46. The stops 65 engage the bracket tops 47 and prevent further downward movement of the tab portions 52 relative to the bracket 41 when fully inserted therein. The clips 12 are thus releasably locked to the body 11. With the holder 1 thus assembled, the clip hook portions 51 are spread whereby their respective openings 56 are enlarged to accommodate the top rail 71. When properly positioned around the top rail 71, the hook portions 51 spring back to their original configurations, narrowing their respective openings 56.

Preferably, the holder 1 is positioned on the side rail 2 at a conveniently accessible location for a patient in the bed 3. For example, the location should be toward a head 75 of the bed 3 and within the user's grasp with minimal movement or shifting of his or her body. The holder back wall mid-section 26 may engage an upright rail 73 as shown in FIG. 1 whereby the holder 1 will be supported against rotating inwardly under the weight of the telephone 35. However, the somewhat rectilinear cross-sectional configurations of the clip hook portions 51 function to resist such rotation when mounted on a rail such as that shown at 71 having a corresponding cross-sectional configuration as shown in FIG. 2.

The telephone 35 may then be placed in the holder 1 with its base unit 36 supported by the base 21 in the receptacle 30. The telephone first and second cords 38 and 39 are positioned in the slots 28 and allowed to dangle from the holder body 11. Of course, the first cord 38 may be taped to some portion of the bed 3 out of the way if desired.

The respective configurations of the front and back walls 15 and 16 function to securely retain the telephone 35 within the receptacle 30 while allowing the handset unit 37 to be easily grasped. As shown in FIGS. 2 and 4, the wall upper edges 23 and 24 are positioned higher at the wall ends 17 and 18 than at the wall mid-sections 25 and 26. The wall ends 17 and 18 substantially cover adjacent portions of both the base unit 36 and the hand set unit 37. At the wall midsections 25 and 26, the respective upper edges 23 and 24 dip below the level of the handset unit 37. Therefore, the head 75 of the bed 3 may be tilted up at a substantial angle and the handset 37 will be retained in place on the base unit 36 by corresponding wall ends 17 and 18. However, at the wall mid-section 25 and 26, the handset unit 37 is exposed and thus easily grasped by a patient using the telephone 35.

With the holder 1 positioned outside the side rail 2, the side rail 2 may be raised or lowered to provide a patient ingress or egress to the bed 3 without removing the holder 1. Furthermore, the holder 1 thus positioned will not interfere with either persons changing the bedding or with the occupant of the bed 3. The clip hook portions 51 are readily spread to increase the size of the respective openings and allow the top rail 71 to pass therethrough for removal of the holder 1. Similarly, the holder 1 is easily disassembled by depressing the legs 74 whereby the clip tab portions 52 may be withdrawn from the respective receivers 45.

It will be appreciated that the body 11 and the clips 12 may be fabricated of, without limitation on the generality of useful materials, metal, wood, or plastic. Preferably, the clips 12 comprise a more flexible material than the body 11 whereby the hook portions 51 are adapted to easily spread to accommodate the top rail 71 and the legs 64 are readily compressed for insertion of respective tab portions 52 in the receivers 45. The body 11, on the other hand, may be more rigid because flexibility is not required as it is with the clips 12. In fact, a relatively rigid body 11 is better adapted for supporting the weight of the telephone 35 without undue deflection and for receiving the clips 12. Thus, fabricating the body and clip portions 11 and 12 separately allows the most appropriate materials to be used for each.

A clip having an alternative configuration with a curved hook portion 81 and an elongated tab portion 82 including a resilient, outwardly biased leg 84 and a pair of stops 87 extending outwardly from side margins 88. The clip 80 is adapted to accommmodate a rail assembly including spaced upper and lower rails 85 and 86 respectively each having a circular cross-sectional configuration. A pair of clips 80 are removably attached to the holder body 11 in the same manner as the clips 12, and the hook portions 81 thereof receive the upper rail 85. The elongated tab portions 82 engage the lower rail 86 whereby the entire holder 1 is maintained in an upright position and prevented from rotating relative to the upper rail 85. Otherwise, the moment about the upper rail 85 caused by the outwardly cantilevered body 11 with the telephone 35 therein would cause the body 11 to swing inwardly toward the bed 3. The clips 12 and 80 are readily interchangeable whereby the body 11 may be mounted on beds having different rail configurations. This feature is particularly advantageous where holders 1 are to be retrofitted on hospital beds 3 having different types of rail assemblies.

Figure 7:
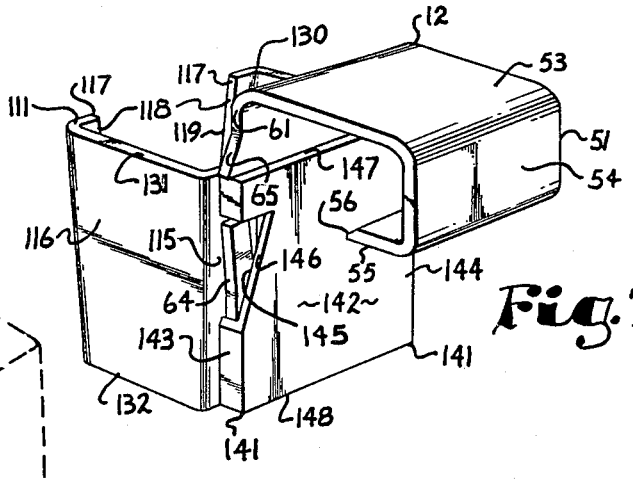
FIG. 7 is an enlarged, perspective view of the first modified embodiment.

A holder comprising a first modified embodiment of the present invention is shown in FIGS. 6 through 7 and generally designated by the reference numeral 101. The holder 101 has a modified body 111 adapted to receive a patient commmunicator 112 of the type manufactured by the Sylvania Corporation. The body 111 comprises a back wall 115, a pair of side walls 116 integrally connected thereto and extending forwardly therefrom and a pair of inwardly extending, opposed front flanges 117. The front flanges 117 are each integrally attached to a respective side wall 116 and terminate at a free margin 118. The free margins 118 define a front opening 119 therebetween. The back and side walls 115 and 116 and the front flanges 117 form a receptacle 130 open at a top 131 and a bottom 132 of the body 111.

The body 111 includes a bracket 141 having a bracket back wall 142 and first and second bracket side walls 143 and 144 respectively. The bracket side walls 143 and 144 are integrally connected to the bracket back wall 142 and extend forwardly therefrom to attach to the body back wall 115. A receiver 145 is formed by the bracket back wall 142 and the side walls 143 and 144 and is open at a bracket top 147 and a bracket bottom 148. The first bracket side wall 143 includes an opening 146 therein communicating with the receiver 145.

In use, the holder 101 is assembled in the same manner as the holder 1 by inserting the tab portion 52 of the clip 12 into the receiver 145 until the stops 65 engage the bracket top 147 and the leg 64 springs into the opening 146. The assembled holder 101 is then mounted on the top rail 171, preferably facing inwardly with respect to the bed 3. Thus mounted, the patient communicator 112 may be placed in the holder 101. As shown in FIG. 6, the patient communicator 112 includes a speaker enclosure 151 for a television or radio (not shown) and a handle 152 depending downwardly from the speaker enclosure 151. The handle 152 is thinner than the speaker enclosure 151 and includes controls such as a nurse call button, television and/or radio volume and channel selection and the like. A line or cord 153 extends downwardly from the patient communicator handle 152 and connects the same to an electrical system wired to the television and/or radio and a call board at a nurses station remote from the patient's room.

The patient communicator 112 is mounted on the holder 101 by placing its cord 153 through the front opening 119 and into the receptacle 130. The patient communicator handle 152 is then inserted at the body top 131 into the receptacle 130. The patient communicator 112 is prevented from slipping through the receptacle 130 by the corresponding tapers of the body side walls 116 and the patient communicator handle 152 and/or by the speaker enclosure 151 engaging the body top 131.

The holder 101 is preferably mounted on a top rail 171 of a rail assembly 102 at a location conveniently retrievable by a patient in a bed 103. Thus, the patient may readily summon assistance by activating the nurse call button or operate the television and/or radio. Properly positioned in the holder 101, the controls 154 are visible and accessible between the free margins 118 of the body front flanges 117 through the body front opening 119.

Because the holder 101 may be mounted at a location on the rail assembly 102 in such a way that it is within easy reach with only limited movement on the part of the patient, an important safety factor is achieved whereby emergency assistance may be easily summoned, even by a person seriously incapacitated and having only limited range of movement. Furthermore, the holder 101 may be positioned in such a way so as not to interfere with a person changing the bedding or with the patient. With the holder 101 properly positioned, the speaker enclosure 151 will be directed toward the patient so as not to disturb others, especially in hospital wards or semi-private rooms. As with the telephone holder 1, tilting the bed 3 and the rail assembly 102 therewith will not affect the position of the holder 101 and the patient communicator 112 relative to the occupant of the bed 103.

A second modified embodiment of a patient communicator holder embodying the present invention is shown in FIG. 8 and generally designated by the reference numeral 201. The holder 201 has a body 211 adapted to receive a patient communicator 212 of a type manufactured by the Radio Corporation of America (RCA). The body 211 includes a back wall 215 and opposite side walls 216 integrally connected thereto and extending forwardly therefrom. The side walls have front flanges 217 integrally connected thereto and extending inwardly therefrom. The front flanges 217 terminate in respective free margins 218 defining a front opening 219. As shown in FIG. 8, the back wall 215, the side walls 216 and the front flanges 217 taper downwardly and form a receptacle 230. The receptacle 230 is adapted to accommodate the handle 252 of the RCA type patient communicator 212 which has a corresponding downwardly tapered configuration. The body 211 includes a bracket 241 forming a receiver 245 for clip tab portions 52 and 82.

The holder 201 functions in a substantially similar fashion to the patient communicator holder 101, and may be mounted on hospital type bed rail assemblies having a variety of different configurations by using a clip having a corresponding configuration, such as those designated 12 and 80. As with the previously described holders 1 and 101, the patient communicator holder 201 comprising a second modified embodiment of the present invention is adapted to receive the clips 12 and 80, which are interchangeable with all of the holders comprising embodiments of the present invention.

It is to be understood that while certain forms of the present invention have been illustrated and described herein, it is not to be limited to the specific forms or arrangement of parts described and shown. For example, clips having hook portions with a variety of configurations for mounting on bed rail assemblies with corresponding cross-sectional shapes may be employed with the holders of the present invention.

What is claimed and desired to secure by Letters Patent is:

1. A holder for a telephone having a cord extending therefrom for mounting on a rail and the like, which comprises:

(a) a body having:

(1) a back wall including opposite ends and a mid-section therebetween;

(2) a front wall having opposite ends and a mid-section therebetween;

(3) a bracket attached to said body back wall and having a bracket back wall in spaced relation therefrom;

(4) a receiver formed between said body and said bracket back walls; and (5) a receptacle for said telephone between said body front and back walls;

(b) a clip including a hook portion engageable with said rail and the like and a tab portion integrally connected to said hook portion and depending downwardly therefrom, said tab portion being slidably receivable in said receiver; and (c) lock means for removably securing said tab portion in said receiver.

2. The holder according to claim 1 which includes:

(a) said body forming a slot for said cord between one of said ends of said body front wall and an adjacent one of said ends of said body back wall.

3. The holder according to claim 1 which includes:

(a) at least one of said body walls terminating at an upper edge positioned relatively higher at one of its ends than at its mid-section.

4. The holder according to claim 1 which includes:

(a) said clip comprising a material which is more flexible than a material comprising said body.

5. A holder for mounting on a bed rail and the like for a telephone having first and second cords extending respectively from opposite ends thereof, which comprises:

(a) a body having:

(1) a back wall including opposite ends and a mid-section, said back wall terminating at an upper edge positioned relatively higher at said opposite ends than at said mid-section;

(2) a front wall having opposite ends and a mid-section, said front wall terminating at an upper edge positioned higher at said opposite ends than at said mid-section;

(3) each said body back wall end terminating in spaced relation from an adjacent body front wall end and forming a respective slot therebetween, each said slot being adapted to receive one of said telephone cords;

(4) a bracket having a bracket back wall and opposite bracket side walls, said bracket side walls being attached to said body back wall and one of said bracket side walls having an opening;

(5) a receiver formed by said bracket and said body back wall; and (6) a receptacle for said telephone between said body front and back walls; and (b) a clip having:

(1) a hook portion terminating in a free end and adapted to receive said rail and the like;

(2) a tab portion integrally connected to and depending downwardly from said hook portion and having a side margin, said hook portion free end being in spaced relation from said tab portion; and (3) a resilient leg biased outwardly from said tab portion side margin, said leg being adapted for springing into said opening and removably locking said tab portion in said receiver.

* * * * *